US006739688B2

(12) United States Patent
Kniazzeh et al.

(10) Patent No.: US 6,739,688 B2
(45) Date of Patent: May 25, 2004

(54) REGISTRATION ERROR REDUCTION IN A TANDEM PRINTER

(75) Inventors: Alfredo G. Kniazzeh, Waltham, MA (US); James W. Slack, III, Lexington, MA (US)

(73) Assignee: Polaroid Corporation, Waltham, MA (US)

( * ) Notice: Subject to any disclaimer, the term of this patent is extended or adjusted under 35 U.S.C. 154(b) by 0 days.

(21) Appl. No.: 10/254,186

(22) Filed: Sep. 25, 2002

(65) Prior Publication Data

US 2004/0056913 A1 Mar. 25, 2004

(51) Int. Cl.[7] ..... B41J 29/393
(52) U.S. Cl. ..... 347/19
(58) Field of Search ..... 347/19, 14, 23, 347/173, 10, 4, 8, 2, 3, 37, 9; 400/120, 55, 56, 58; 358/300

(56) References Cited

U.S. PATENT DOCUMENTS

| | | | | |
|---|---|---|---|---|
| 4,836,697 A | | 6/1989 | Plotnick et al. | 400/120 |
| 5,440,328 A | | 8/1995 | Nardone et al. | 347/173 |
| 5,576,744 A | * | 11/1996 | Niikura et al. | 347/14 |
| 5,617,122 A | * | 4/1997 | Numata et al. | 347/14 |
| 5,847,742 A | | 12/1998 | Nishimura | 347/173 |
| 6,106,094 A | * | 8/2000 | Otani et al. | 347/19 |

FOREIGN PATENT DOCUMENTS

| | | | |
|---|---|---|---|
| EP | 0 878 311 A1 | 2/1998 | B41J/11/46 |
| EP | 1 044 820 A1 | 4/1999 | B41J/15/16 |

* cited by examiner

*Primary Examiner*—Stephen D. Meier
*Assistant Examiner*—Charles Stewart, Jr.

(57) ABSTRACT

A multi-head tandem printer is disclosed which includes an optical encoder or other device mounted on a roller (the "encoder roller") in contact with the print media. The device and encoder roller serve as a tachometer to measure the media transport speed (referred to herein as the "print speed"). The print heads are arranged so that the unloaded receiver length between two print heads is an integral multiple of the unloaded receiver length transported for each revolution of the encoder roller. In one embodiment, the print heads are arranged so that the inter-head spacing is an integer multiple of the circumference of the encoder roll. Adjustments may be made to the inter-head spacing to take into account factors such as the thickness of the receiver and the curvature at the line of receiver contact with the encoder roll. Such techniques may be employed to reduce the effect of mechanical errors on color registration.

8 Claims, 4 Drawing Sheets

REGISTRATION ERROR REDUCTION IN A TANDEM PRINTER

CROSS REFERENCE TO RELATED APPLICATIONS

This application is related to copending, commonly-assigned U.S. patent application Ser. No. 10/080,883, filed on Feb. 22, 2002, entitled "A High-Speed Photo-Printing Apparatus," which is hereby incorporated by reference.

BACKGROUND

1. Field of the Invention

The present invention relates to reducing registration errors in tandem printers and, more particularly, to reducing registration errors in tandem printers by equalizing roller diameter and print head spacing.

2. Related Art

Conventional color thermal printers typically include multiple thermal print heads, each of which is responsible for printing a distinct color. In a four-head printer, for example, the four print heads may be responsible for printing cyan, magenta, yellow, and black, respectively. The print heads are typically spaced some distance apart from each other in a row or other configuration.

The medium on which output is to be printed (referred to as the "output medium," "web," or "receiver") is typically provided on a continuous roll, referred to as the "receiver roll." The receiver is pulled from the receiver roll through the printer by a drive capstan roller located after the final print head. In this manner the receiver passes by and makes contact with each print head in succession. Each print head transfers pigment of a corresponding color from a donor element to the receiver as the receiver passes by it. In this way, a four color image may be printed by successively printing each of four single-color layers on the output medium. The processes of printing distinct colors of an image at successive print stations is referred to as "tandem printing."

Printing a single four-color image in this manner requires that the image layers be in precise registration (alignment) with each other. The "registration" of multiple layers (and of individual dots within them) refers to the relative position between the layers. Ideally, all layers in an image are superimposed exactly on (i.e., precisely registered with) each other. Even a slight misregistration may cause noticeable visual artifacts, thereby detracting from the perceived quality of the resulting image.

Misregistration may be caused by any of a variety of factors. For example, although in an ideal printer the receiver moves through the printer at a constant speed, in practice the speed of the receiver may vary. Such variations in speed, if not properly taken into account, may cause a particular print head to print some or all of an image at the wrong location on the receiver, causing misregistration and other problems. For example, variation in the speed of the receiver while a print head is printing may cause the image layer being printed either to be compressed (if the receiver slows down) or stretched (if the receiver speeds up) on the receiver. Although such a distortion may not be objectionable in an image printed by a single print head, multiple such distortions superimposed on each other by multiple print heads can cause problems such as objectionable color variations in what should be areas of uniform color.

Various attempts have been made to ensure proper registration among the various layers of an output image by correcting for variations in receiver speed. For example, in at least one system registration marks have been printed along the lateral edges of the output medium. Optical sensors positioned at each print head have read the registration marks to enable the printer to continuously recalculate the correct printing position for each layer of the image to be printed, thereby allowing the printer to compensate for shifting and stretching of the image on the output medium that may occur at or between each print head. In at least one other system, an integral relationship has been established between the circumference of two output capstan drive rollers and the distance between successive print heads.

Although these approaches may provide some improvement over systems which do not include any corrections for speed variation, they may fail to measure variations in web speed with the accuracy required. The capstan drive roller, for example, may not provide a perfect measurement of web speed because it can slip as the back tension on the web varies.

What is needed, therefore, are improved techniques for correcting for registration errors in tandem printers.

SUMMARY

A multi-head tandem printer is disclosed which includes an optical encoder or other device mounted on a roller (the "encoder roller") in contact with the print media. The device and encoder roller serve as a tachometer to measure the media transport speed (referred to herein as the "print speed"). The print heads are arranged so that the unloaded receiver length between two print heads is an integral multiple of the unloaded receiver length transported for each revolution of the encoder roller. In one embodiment, the print heads are arranged so that the inter-head spacing is an integer multiple of the circumference of the encoder roller. Adjustments may be made to the inter-head spacing to take into account factors such as the thickness of the receiver and the curvature at the line of receiver contact with the encoder roller. Such techniques may be employed to reduce the effect of mechanical errors on color registration.

In one aspect, for example, the present invention features a printing apparatus comprising a plurality of print heads, means for feeding a receiver past each of the plurality of print heads, and an encoder roller, wherein the unloaded receiver length between at least two of the plurality of print heads is an integral multiple of the unloaded receiver length transported between the at least two print heads for each revolution of the encoder roller.

The unloaded receiver length between each successive print head may be an integral multiple of the unloaded receiver length transported between the at least two print heads for each revolution of the encoder roller.

In particular, the distance between at least two of the plurality of print heads may be an integral multiple of the circumference of the encoder roller. The distance between each successive print head, for example, may be an integral multiple of the circumference of the encoder roller.

The encoder roller may be located prior to the plurality of print heads in the path of the receiver. The printing apparatus may further include print speed measuring means for measuring an instantaneous print speed of the printing apparatus, the print speed measuring means including the encoder roller and an encoder mounted to the encoder roller.

The printing apparatus may further include means for receiving output from the print speed measuring means, and means for adjusting an output timing of an least one of the plurality of print heads based on the output received from the print speed measuring means.

Other features and advantages of various aspects and embodiments of the present invention will become apparent from the following description and from the claims.

DETAILED DESCRIPTION

A multi-head tandem printer is disclosed which includes an optical encoder or other device mounted on a roller (the "encoder roller") in contact with the print media. The device and encoder roller serve as a tachometer to measure the media transport speed (referred to herein as the "print speed"). The print heads are arranged so that the unloaded receiver length between two print heads is an integral multiple of the unloaded receiver length transported for each revolution of the encoder roller. In one embodiment, the print heads are arranged so that the inter-head spacing is an integer multiple of the circumference of the encoder roller. Adjustments may be made to the inter-head spacing to take into account factors such as the thickness of the receiver and the curvature at the line of receiver contact with the encoder roller. Such techniques may be employed to reduce the effect of mechanical errors on color registration.

Figure 1:
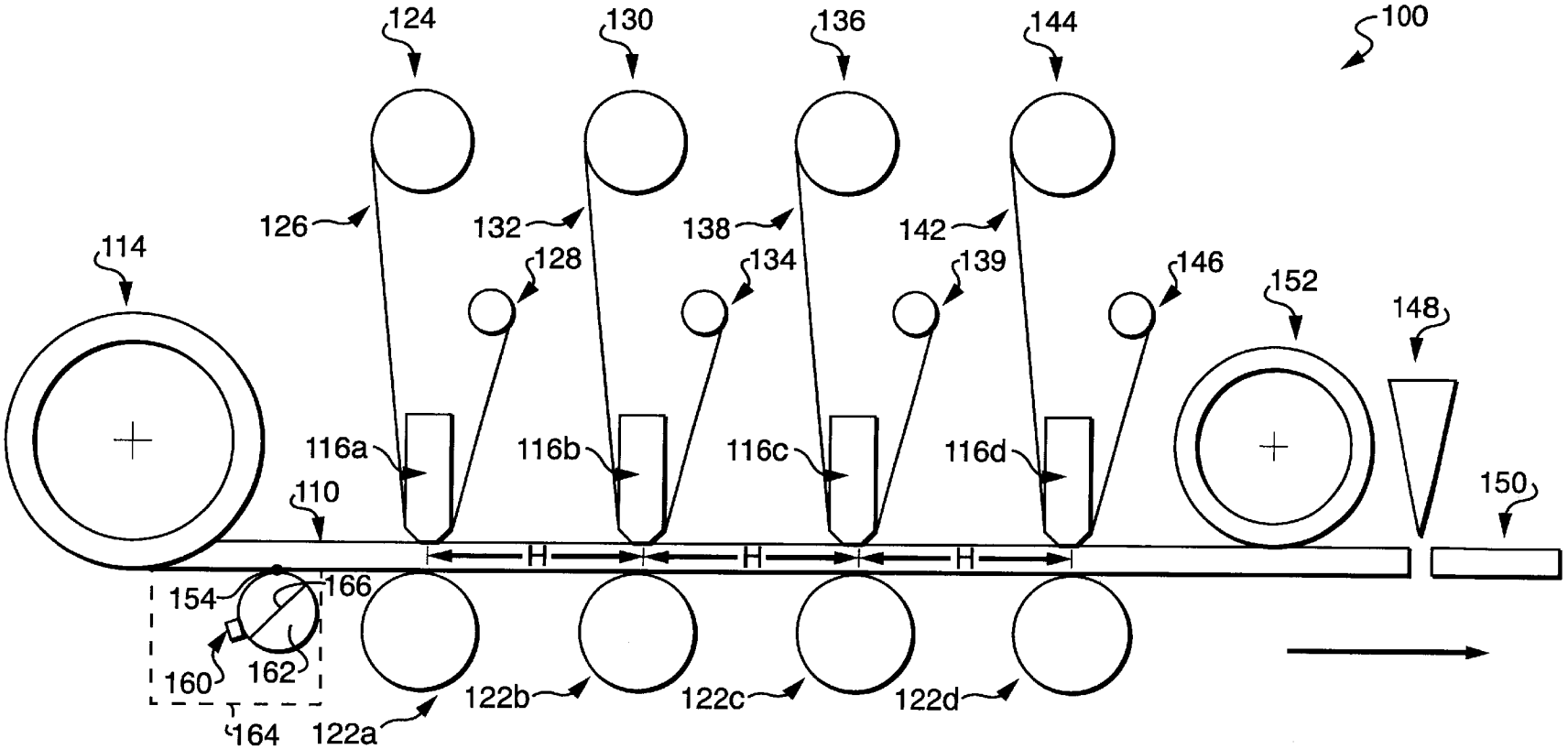
FIG. 1 is a full sectional side elevational view of a tandem printing mechanism according to one embodiment of the present invention.

Referring to FIG. 1, a multi-head tandem printing mechanism 100 according to one embodiment of the present invention is shown. The printing mechanism 100 may, for example, be used in a commercial photo-printing kiosk, as described in more detail in the above-referenced patent application entitled "A High-Speed Photo-Printing Apparatus."

Receiver 110 is fed from a receiver roll 114. Although the path of receiver 110 is shown as straight in FIG. 1, it should be understood that other paths, for example curved or arcuate paths, may also be used. The receiver 110 is translated past three thermal print heads 116*a–c*, opposed by platen rollers 122*a–d* respectively. The first thermal print head 116a is fed from roll 124 with a donor element 126 , bearing the first of the three subtractive primary colors (cyan, magenta, or yellow). The order of printing of the colors may vary. After printing of the first color, the spent donor element is taken up on a roll 128. The second thermal print head 116*b* is fed from roll 130 with donor element 132, corresponding to the second primary color. The spent donor element is taken up on roll 134. The third thermal print head 116*c* is fed from roll 136 with donor element 138, corresponding to the third primary color. The spent donor element is taken up on roll 139.

A fourth printing head (or heating element) 116*d* may optionally be used for applying an overcoat layer 142, which may be laminated or transferred to receiver 110. Alternatively, 142 may be a white, opaque substrate as described in more detail below. Element 140 may be a thermal print head, a heated roller, or simply a pressure roller. The overcoat or white opaque substrate 142 is fed from roll 144. If a carrier web is used for the overcoat or white opaque substrate 142, it is taken up on roll 146. If no carrier web is used, substrate 142 is simply laminated to receiver 110, and roller 146 is not needed. Following lamination or transfer of substrate 142, a cutter 148 may be used to separate the printed images, affording a final printed image 150 onto which all three primary colors have been printed. The cutter 148 may optionally separate a small sliver (not shown) of receiver 110 between pictures so as not to have to precisely register a single cut with the junction between successive pictures. The slivers so separated may be directed into a receptacle (not shown) for later disposal. The prints themselves may be delivered to the user by means of a chute or similar device.

Donor elements 126, 132 and 138 may comprise very thin substrates (of thickness typically in the range 2.5–8 micrometers) onto which the appropriate donor material has been coated. In the case of dye diffusion thermal transfer, the donor material is typically a dye incorporated into a polymer binder, as described for example in Hann, R. A. and Beck, N. C., J. Imaging Technol., (1990), 16(6), 138–241 and Hann, R. A., Spec. Pub. R. Soc. Chem. (1993), 133, 73–85.

In the case of thermal mass transfer, the donor material is commonly a dye or pigment formulated with a wax or resin (or a combination of the two) as vehicle, as described for example in U.S. Pat. No. 5,569,347. Alternatively, however, thermal mass transfer imaging may be used, in which case the donor element may be such as-is described in copending, commonly-assigned U. S. patent application Ser. No. 09/745,700, filed Dec. 21, 2000, entitled: "Thermal Transfer Recording System[[.]]", now U.S. Pat. No. 6,537,410 B2.

The receiver 110 should be chosen so as to be compatible with the donor material used. Thus, for dye diffusion thermal transfer, the receiver 110 bears a polymer coating for accepting the transferred dyes, as described in Hann, R. A. and Beck, N. C., J. Imaging Technol., (1990), 16(6), 138–241 and Hann, R. A., Spec. Pub. R. Soc. Chem. (1993), 133, 73–85. For thermal mass transfer, the receiver may bear a microporous layer, as described for example in U.S. Pat. Nos. 5,521,626 and 5,897,254, or a softening layer, as described for example in U.S. Pat. No. 4,686,549. As described for example in U.S. Pat. No. 5,144,861, the receivers 110 used for thermal transfer media of either type are desirably compliant and of uniform thermal conductivity. One example of the receiver 110 for use in conjunction with a thermal mass transfer donor element according to the invention is described in copending commonly-assigned U.S. patent application Ser. No. 10/159,871, filed May 30, 2002, entitled "Thermal Mass Transfer Imaging System."

Receiver 110 may be opaque or transparent. In the case where receiver 110 is transparent, and a reflective print is the desired output, substrate 142 is desirably opaque, and the final image is viewed through receiver 110. In the case wherein receiver 110 is opaque, and the material transferred by element 140 is transparent, the final image is viewed through the material transferred by element 140. The image printed in one case is the mirror image of that printed in the other.

The printing mechanism 100 also includes an optical encoder 160 mounted on a roller 162 (referred to as the "encoder roller") in contact with the receiver 110. The encoder 160 and encoder roller 162 are illustrated in outline for ease of illustration. One example of the optical encoder 160 is the model H15-type encoder available from Dynamics Research Corporation of Wilmington, Massachusetts.

The model H15 comes in various configurations. In one embodiment, for example, the model H1514E481A1000Y154 is used as the optical encoder 160, although any optical encoder may be used. The model H15 encoder has a frequency response of up to 200 KHz in all channels, resolutions of up to 12,500 cycles/revolution, and a diameter of 1.51 inches.

The combination of the optical encoder 160 and the encoder roller 162 serves as a tachometer 164 to measure the transport speed (print speed) of the receiver 110 as it passes through the print mechanism 100. The encoder roller 162 has a diameter $d_e$ (the length of bisector 166) and a circumference $c_e$ equal to $\pi d_e$.

As described above, the print speed of the printing mechanism 100 may vary, potentially causing misregistration in the printed image 150. The encoder 160 may output a square wave or other periodic wave with some number of cycles of the wave repeated for every revolution of the encoder; the instantaneous frequency of said wave being proportional to the instantaneous print speed. The print engine may derive the instantaneous print speed of the print mechanism 100 based on the output of the encoder 160, and adjust the times at which the print heads 116*a–d* produce their output accordingly. In particular, when the instantaneous print speed s is slower than expected, the output of the print heads 116*a–d* may be delayed by a corresponding time interval. Conversely, when the instantaneous print speed s is faster than expected, the print heads 116*a–d* may produce their output earlier than would be the case otherwise. A controller (not shown) may communicate the speed measurements obtained from the encoder 160 to the print heads 116*a–d* to enable them to adjust the print timing accordingly.

One limitation of this approach is that the tachometer 164 (which includes the encoder 160 and the encoder roller 162) may not measure the instantaneous print speed s with perfect accuracy. Practical, low cost devices to measure the print speed s have too much measurement error to achieve good image quality if further steps are not taken.

In one embodiment of the present invention, the spacing H between one or more pairs of the print heads 116*a–d* (the "inter-head spacing") is made equal to an integral multiple of the circumference $c_e$. In other words, the inter-head spacing H is made equal to the circumference $c_e$ multiplied by an integer constant n which may be chosen freely.

Making the inter-head spacing H equal to an integral multiple of the encoder roller circumference $c_e$ advantageously eliminates, or at least greatly reduces, registration errors resulting from variations in the print speed s. The reason for this is that the error in the tachometer 164 is repeatable from one revolution of the encoder roller 162 to the next. As a result, the length of the receiver 110 between each of the print heads 116*a–d* is equal to an integral multiple of the length of receiver 110 which moves during exactly one rotation of the encoder roller 162. Distortions in the various layers of the printed image 150 are therefore correlated with each other. Correlated distortions do not cause objectionable color shifts, because the small-scale features of the various image layers remain in registration. Thus, by making the inter-head spacing H equal to an integral multiple of the encoder roller circumference $c_e$, one may achieve high image quality with readily available components which would not achieve sufficient accuracy without this additional feature.

The techniques described above work best when the surface of the encoder roller 162 is rigid, when there is no slip between the receiver 110 and encoder roller 162, and when the receiver 110 does not stretch. In practice, these and other factors, however, may affect the extent to which the printing mechanism 100 produces an output image (e.g., the image 150) having acceptable registration. Such factors include, for example, the thickness of the receiver 110, the receiver curvature at the line of contact between the receiver 110 and the encoder roller 162, squeegying of the rubber encoder roller covering (not shown) in the contact region, differential stretch of the receiver 110 between the encoder contact point 154 and the span between the two print heads of interest, finite receiver thickness and wrap of the platen rollers 122*a–d*, and bag on the platen rollers 122*a–d*.

It was stated above that the print heads 116*a–d* may be arranged so that the inter-head spacing H is an integer multiple of the circumference $c_e$ of the encoder roller 162. More generally, if factors such as receiver thickness, curvature, and stretch are taken into account, the unloaded receiver length between two successive ones of the print heads 116*a–d* may be made equal to an integral multiple of the unloaded receiver length transported for each revolution of the encoder roller 162 in order that encoder mechanical errors have minimum effect on color registration. In particular, the length of unloaded receiver transported in an integral multiple number of rotations of the encoder roller 162 may be made equal to the length of unloaded receiver between the cyan and magenta print heads 116*a* and 116*b*. The cyan and magenta print heads 116*a* and 116*b* may be chosen because cyan and magenta are seen most sharply by the human eye.

One way to take these factors into account to maintain proper registration among layers of the printed image 150 is to calculate an "effective inter-head spacing" $H_e$ which includes both the actual (original) inter-head spacing H plus a (positive or negative) correction based on an analysis of some or all of the factors described above. The effective inter-head spacing $H_e$ may be made equal to an integral multiple of the selected encoder roller circumference $c_{eo}$, i.e., $H_e = nc_{eo}$. A selected encoder roller diameter $d_{eo}$ may then be calculated as $c_{eo}/\pi$.

Figure 3:
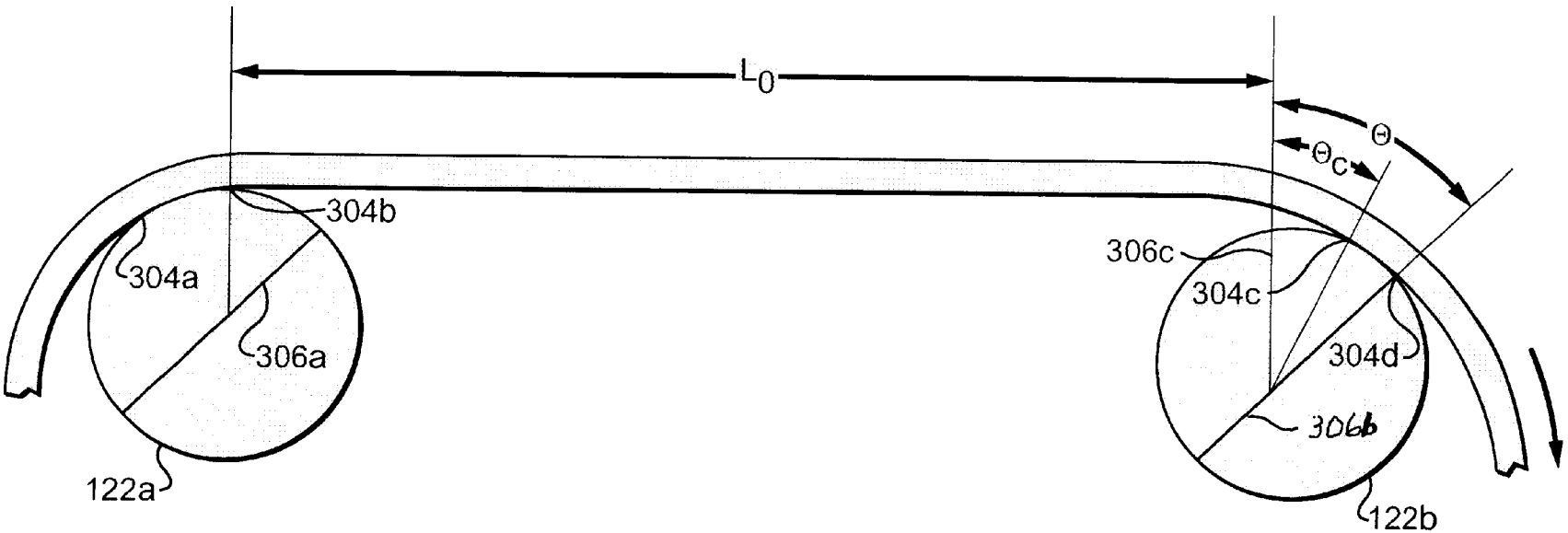
FIG. 3 is an enlarged view of two print heads and a portion of the receiver of the printing mechanism of FIG. 1.

Examples of techniques will now be described for calculating the selected encoder roller diameter $d_{eo}$. Referring to FIG. 3, an enlarged view is shown of the platen rollers 122*a* and 122*b*. The discussion below, however, is equally applicable to the other platen rollers 122*c* and 122*d*, and to the receiver 110 and the printing mechanism 100 more generally.

A portion 302 of the receiver 110 passes over and between the two platen rollers 122*a* and 122*b*. Portion 302 comes into contact with platen roller 122*a* at point 304*a*, follows the curvature of platen roller 122*a*, and then continues in an essentially straight path from point 304*b*. Similarly, portion 302 comes into contact with platen roller 122*b* at point 304*c*, where the tangent to the web has rotated an angle $\theta_c$ from the tangent between 306*c* and 304*c*, follows the curvature of platen roller 122*b*, and then continues in a straight path from point 304*d*. The print heads 116*a* and 116*b* (not shown in FIG. 3) contact the receiver portion 302 essentially at points 304*b* and 304*d*.

Let the diameter of the platen rollers 122*a* and 122*b* be d (the length of bisectors 306*a–b*) and the thickness of the portion 302 be h. Let $L_o$ be the distance between the centers of the platen rollers 122*a–b*. Let H be the inter-head spacing and $L_m$ be the distance between the cyan head 116*a* and the magenta head 116*b* (FIG. 1) taken by an inextensible mem brane. Let θ be the angle between line segments 306*b* and 306*c*. Then H and $L_m$ are given by Equation 1:

$$H=L_o+\theta d/2,\ L_m=H+\theta h/2. \quad \text{Equation 1}$$

Let $L_1$ bet the unloaded media length between the cyan and magenta print heads 116*a* and 116*b* (i.e., the media length when tension is removed). Then $L_1$ is given by Equation 2:

$$L_1=L_m+\text{bag}-\text{stretch}(P_1) \quad \text{Equation 2}$$

where stretch ($P_1$) is given by Equation 3:

$$stretch(P_1)=\frac{P_1 L_m}{Ehw}, \quad \text{Equation 3}$$

$P_1$ is the receiver tension between the cyan and magenta print heads 116*a* and 116*b*, and E, h and w are the receiver elastic modulus, thickness and width, respectively.

Bag is excess length taken by a real web with a finite flexural rigidity D given by Equation 4:

$$D=Eh^3w/12 \quad \text{Equation 4}$$

Then bag is given by Equation 5 and Equation 6:

$$\text{bag}=\lambda\left[2-\sqrt{2(1+\cos\theta)}\right]-(\theta+\sin\theta)d/2, \quad \theta<\theta_c\equiv 2\sin^{-1}(\eta/2) \quad \text{Equation 5}$$

$$\text{bag}=\left[2\eta-\eta\sqrt{1-\eta^2/4}-\sin^{-1}\left(\eta\sqrt{1-\eta^2/4}\right)\right]d/2, \quad \theta>\theta_c,\ \text{where}\ \lambda=\sqrt{D/PI},\ \eta\equiv\frac{2\lambda}{d} \quad \text{Equation 6}$$

For small θ and η, bag is given by Equation 7 and Equation 8:

$$\text{bag}=\lambda\theta^2/4-d\theta^3/12,\ \theta<\theta_e=\eta+\eta^3/24 \quad \text{Equation 7}$$

$$\text{bag}=d\eta^3/24=\lambda^3/3d^2,\ \theta>\theta_c. \quad \text{Equation 8}$$

This calculation of bag assumes sufficient head force so that the contact lines of the platen roller and the print head are essentially the same and that the web is straight immediately after the print head (to the right in the example illustrated in the example in FIG. 3). It also neglects platen roller deformation.

The length of web passing the encoder roller 162 in one revolution is given by Equation 9:

$$L_e=\pi d_e(1+h/2R), \quad \text{Equation 9}$$

where $d_e$ is the encoder roller diameter and R is the radius of curvature of the web at the contact line on the encoder roller.

The increment h/2R accounts for the fact that the neutral axis of the web travels farther than the inner surface by the factor (1+h/2R) or alternatively that the inner surface is compressed by a strain h/2R. This assumes that the web is symmetric so that the distance from the inner surface to the neutral axis is h/2, that there is no slip at the roller surface, and that the roller compression, hysteresis and bearing friction are negligible.

Figure 4:
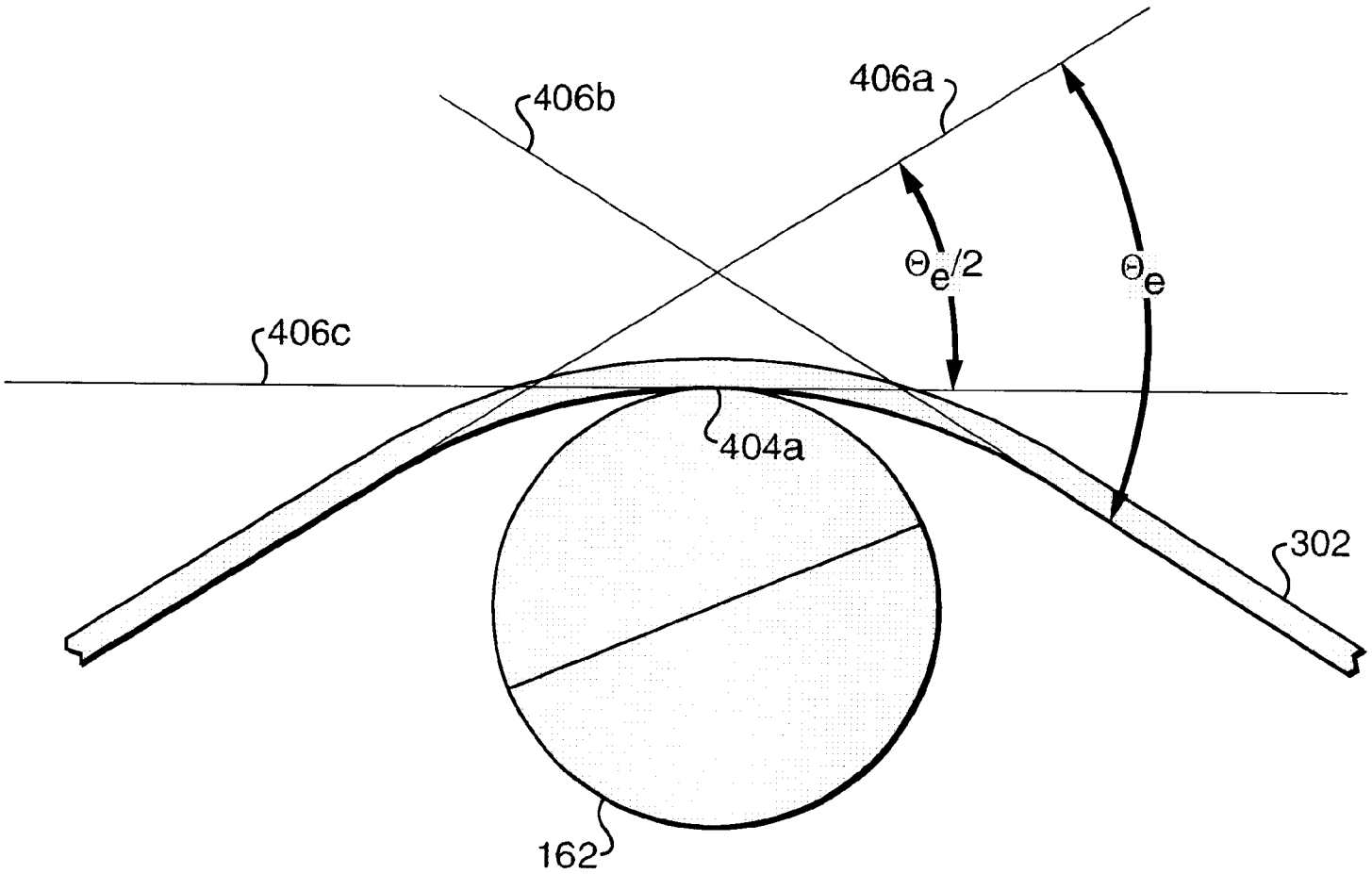
FIG. 4 is an enlarged view of the encoder roller and a portion of the receiver of the printing mechanism of FIG. 1.

Referring to FIG. 4, an enlarged view of the encoder roller 162 and the receiver portion 302 are shown. The diameter $d_e$ of the encoder roller 162 is the length of bisector 402. Web portion 302 bends into line contact with encoder roller 162 at point 404*a*, where tangent line 406*c* bisects the angle $\theta_e$, and then unbends into another straight path. The encoder wrap angle $\theta_e$ is the angle between successive free-web tangents 406*a* and 406*b*.

The radius of curvature at point 404*a* is given by Equation 10:

$$1/R=(P_e/D)^{1/2}\theta_e/2, \quad \text{Equation 10}$$

for small encoder wrap angle $\theta_e$, and large $R>d_e/2$, where $P_e$ is the web tension at the encoder roller 162. If $L_e$ were unloaded its length would be as shown in Equation 11:

$$L_{el}=L_e\left(1-\frac{P_e}{Ehw}\right)=\pi d_e\left(1+\frac{h\theta_e}{4}\left(\frac{P_e}{D}\right)^{\frac{1}{2}}-\frac{P_e}{Ehw}\right) \quad \text{Equation 11}$$

Minimum error requires $L_1=nL_{e1}$. Designating $d_{eo}$ as the encoder roller diameter that satisfies this requirement, $d_{eo}$ is given by Equation 12:

$$d_{eo}=(L_1/n\pi)\Big/\left(1+\frac{h\theta}{4}\left(\frac{P_e}{D}\right)^{\frac{1}{2}}-\frac{P_e}{Ehw}\right) \quad \text{Equation 12}$$

For $P_1$=10 lbs, $P_e$=5 lbs, Ehw=10,000 lbs, h=0.009 inch, D=0.06759 lb inch$^2$, d=15 mm=0.6 inch, θ=20 degrees=0.349 rad, $\theta_e$=0.04 rad, and $L_o+\theta d/2$=2.5 inches, we find λ=0.0822 in, η=0.2739<θ, bag=$d\eta^3/24$=0.00051 inch, $L_m$=2.50157 inch, $L_1=L_m(1-0.001)+0.00051$=2.49958. Then $d_{eo}$ and the effective inter-head spacing $H_e$ are given by Equation 13:

$$H_e=\left[H\left(1-\frac{(P_1-P_e)}{Ehw}-\frac{h\theta_e}{4}\left(\frac{P_e}{D}\right)^{0.5}\right)+\frac{\theta h}{2}+\frac{1}{3d^2}\left(\frac{P_1}{D}\right)^{1.5}\right],\quad d_{eo}=\frac{H_e}{n\pi}. \quad \text{Equation 13}$$

For n=2, $d_{eo}$=0.39769 inch, compared to H/(nπ)=0.39789 inch without these considerations. If the encoder 160 has a diameter $d_e$, not equal to $d_{eo}$, and an eccentricity ϵ, then the registration error between cyan and magenta dots will be $\delta=\delta_{max}\cos(2\ vt/d_e)$, $\delta_{max}=2\pi(d_{eo}/d_e-1)\epsilon$, where v is velocity and t is time. For ϵ=25 micron, $d_e-d_{eo}$=0.0002 inch=5 micron, $\delta_{max}$=0.08 micron. These multiple small corrections are somewhat compensating for this case. The development is general within the stated assumptions.

Figure 2:
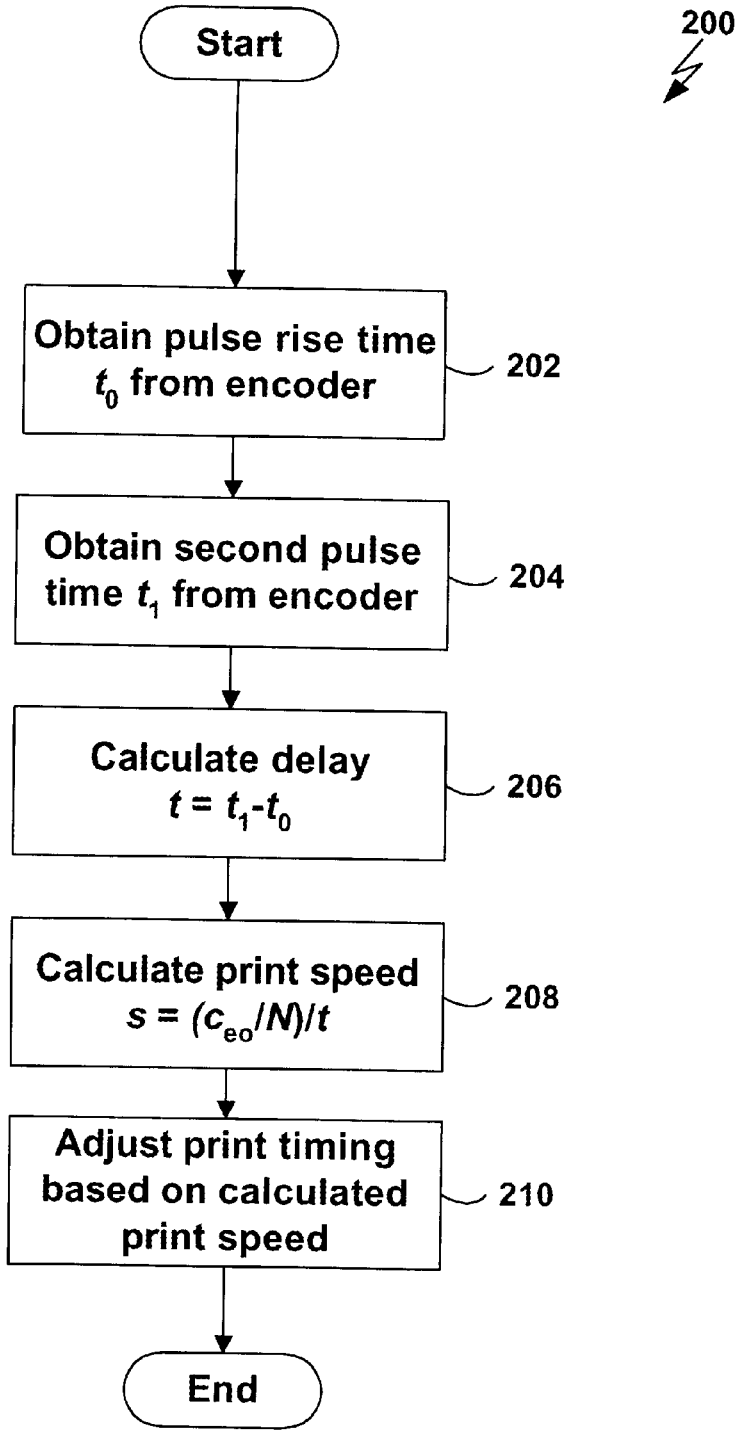
FIG. 2 is a flowchart of a method for calculating the instantaneous print speed of a web through the tandem printing mechanism of FIG. 1 according to one embodiment of the present invention.

Once the corrected encoder roller diameter $d_{eo}$ is obtained, it may be used to control the print speed of the printing mechanism 100 to reduce registration errors. Referring to FIG. 2, for example, a flowchart is shown of a method 200 that may be used to calculate the instantaneous print speed s based on the output of the encoder 160 and to adjust the print timing in response. The method 200 may, for example, be executed by software or firmware in the engine of the print mechanism 100.

The method 200 obtains readings from the encoder 160 of a pulse rise time to (step 202) and a second pulse time $t_1$ (step 204). The method 200 calculates t, the delay between times $t_0$ and $t_1$, which represents the delay between two successive cycles of the encoder output 160 (step 206). The method 200 calculates the instantaneous print speed s based on the delay t and the corrected circumference $c_{eo}$ ($\pi d_{eo}$) of the encoder roller 162 using the formula $s=(c_{eo}/N)/t$ (step 208) where N is the number of cycles per revolution of the encoder. The method 200 adjusts the print timing based on the print speed calculated in step 208 (step 210).

The print mechanism 100 may, for example, periodically sample the instantaneous print speed s using the method 200 and adjust the times at which the print heads 116*a–d* produce their output accordingly. In particular, when the instantaneous print speed s is slower than expected, the output of the print heads 116*a–d* may be delayed by a corresponding time interval. Conversely, when the instantaneous print speed s is faster than expected, the print heads 116*a–d* may produce their output earlier than would be the case otherwise. A controller (not shown) may communicate the speed measurements obtained from the encoder 160 to the print heads 116*a–d* to enable them to adjust the print timing accordingly.

The particular size and location of the encoder roller 162 may be varied. Furthermore, encoders other than optical encoders may be used to perform the same function as the encoder 160. In general, any roller-mounted device for measuring print speed may be employed to perform the same function as the encoder 160, so long as the roller to which the device is mounted has a diameter consistent with the techniques described herein.

It is to be understood that although the invention has been described above in terms of particular embodiments, the foregoing embodiments are provided as illustrative only, and do not limit or define the scope of the invention. Various other embodiments, including but not limited to the following, are also within the scope of the claims.

Elements and components described herein may be further divided into additional components or joined together to form fewer components for performing the same functions.

What is claimed is:

1. A printing apparatus comprising:

a plurality of print heads;

means for feeding a receiver past each of the plurality of print heads; and an encoder roller;

wherein the unloaded receiver length between at least two of the plurality of print heads is an integral multiple of the unloaded receiver length transported between the at least two print heads for each revolution of the encoder roller.

2. The printing apparatus of claim 1, wherein the encoder roller is located prior to the plurality of print heads in the path of the receiver.

3. The printing apparatus of claim 1, further comprising print speed measuring means for measuring an instantaneous print speed of the printing apparatus, the print speed measuring means comprising the encoder roller and an encoder mounted to the encoder roller.

4. The printing apparatus of claim 3, further comprising:

means for receiving output from the print speed measuring means; and means for adjusting an output timing of at least one of the plurality of print heads based on the output received from the print speed measuring means.

5. The printing apparatus of claim 1, further comprising the receiver.

6. The printing apparatus of claim 1, wherein the unloaded receiver length between each successive print head is an integral multiple of the unloaded receiver length transported between the at least two print heads for each revolution of the encoder roller.

7. The printing apparatus of claim 1, wherein the distance between at least two of the plurality of print heads is an integral multiple of the circumference of the encoder roll.

8. The printing apparatus of claim 1, wherein the distance between each successive print head is an integral multiple of the circumference of the encoder roll.

* * * * *